US010392581B2

(12) United States Patent
Han et al.

(10) Patent No.: US 10,392,581 B2
(45) Date of Patent: Aug. 27, 2019

(54) CARBON MATERIAL WICK FOR CANDLE AND CANDLE INCLUDING THE SAME

(71) Applicant: Samyoung Machinery Co., Ltd., Gongju-Si (KR)

(72) Inventors: Kuk Hyun Han, Daejeon (KR); Yea Won Shim, Daejeon (KR); Dal Ho Kim, Daejeon (KR); Kyung Hwa Ji, Daejeon (KR)

(73) Assignee: Samyoung Machinery Co., Ltd., Gongju-si (KR)

( * ) Notice: Subject to any disclaimer, the term of this patent is extended or adjusted under 35 U.S.C. 154(b) by 12 days.

(21) Appl. No.: 15/649,333

(22) Filed: Jul. 13, 2017

(65) Prior Publication Data

US 2018/0023034 A1 Jan. 25, 2018

(30) Foreign Application Priority Data

Jul. 22, 2016 (KR) ..... 10-2016-0093056

(51) Int. Cl.
*C11C 5/00* (2006.01)

(52) U.S. Cl.
CPC ..... *C11C 5/006* (2013.01); *C11C 5/004* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,462,235 | A * | 8/1969 | Summers | C11C 5/006 431/289 |
| 2004/0137392 | A1* | 7/2004 | Garnys | C11C 5/002 431/126 |
| 2009/0042153 | A1* | 2/2009 | Ronen | C10L 1/02 431/126 |
| 2012/0148966 | A1 | 6/2012 | Ramaker et al. | |

FOREIGN PATENT DOCUMENTS

| | | | |
|---|---|---|---|
| JP | H0841487 | A | 2/1996 |
| KR | 200179220 | Y1 | 4/2000 |
| KR | 100783490 | B1 | 12/2007 |
| KR | 1020130073481 | A | 7/2013 |
| KR | 101370867 | B1 | 3/2014 |
| KR | 101392227 | B1 | 5/2014 |
| KR | 1020140081875 | A | 7/2014 |
| KR | 101492333 | B1 | 2/2015 |
| KR | 1020160000112 | A | 1/2016 |

* cited by examiner

*Primary Examiner* — Ellen M McAvoy
*Assistant Examiner* — Chantel L Graham
(74) *Attorney, Agent, or Firm* — McCoy Russell LLP

(57) ABSTRACT

Provided is a wick for a candle including a carbon material. In addition, provided is a candle including the wick for a candle. By using the wick for a candle according to the present invention, it is possible to provide the candle in which a length of the wick combusted at the time of combustion is not long and ash of the wick does not fall.

12 Claims, 9 Drawing Sheets

CARBON MATERIAL WICK FOR CANDLE AND CANDLE INCLUDING THE SAME

CROSS-REFERENCE TO RELATED APPLICATIONS

This application claims priority under 35 U.S.C. § 119 to Korean Patent Application No. 10-2016-0093056, filed on Jul. 22, 2016, in the Korean Intellectual Property Office, the disclosure of which is incorporated herein by reference in its entirety for all purposes.

TECHNICAL FIELD

The following disclosure relates to a wick for a candle including a carbon material, and a candle including the same.

BACKGROUND

A candle may provide a warm and special mood as a natural light source unlike an artificial light source such as electric lighting, and have additional advantages such as deodorization, fragrance, etc., such that use of the candle has gradually increased. The candle is lighting fuel produced by molding paraffin, bees wax, or the like, and a combustible solid, and inserting a wick into the center of the candle. In the case of lighting the wick, the candle positioned at the bottom of the wick is melted, and the melted candle rises upwardly along the wick by a capillary phenomenon to thereby be vaporized and combusted at a distal end portion of the wick, such that a flame burns. A combustion temperature of a surface flame of the candle is 1400° C. or more, a temperature of the brightest inner flame thereof is 1200° C. or more, and a temperature of a flame center thereof is 400 to 900° C.

The wick is generally used in material forms of a cotton wick, a wood wick, a zinc wick, a paper wick, etc. However, conventional candles into which wicks are inserted have unique problems as follows.

First, there is an excessive length amount of the remaining combusted wick. When an excessive length amount of the combusted wick remains, a flame size of the candle is increased, the candle burns much faster, and a large amount of soot due to combustion also occurs. Therefore, to control the flame size, it is inconvenient to periodically cut the wick or discard wax drippings from the candle. Further, in the case of the cotton wick, there is a case where a wick tip becomes bent after the candle is blown out, such that it is troublesome to cut the wick short before lighting the candle.

Second, there is a problem in that ash falls from the wick. When the ash of the wick falls, the candle is stained and looks dirty in view of aesthetics, and it is inconvenient to remove the ash.

In recent years, technologies for reducing soot and burning the wick properly at the time of combustion, such as a smokeless wick made of natural fibers, an eco wick, etc., have been developed. However, due to material limitations of the natural fibers, it is not enough to solve the above-described problems.

U.S. Patent Application Publication No. 2012-0148966 discloses a candle wick having a cross (+) shape in which the candle wick is perpendicularly oriented. In this case, the candle wick may be supported in an upright manner through the cross (+) shape, but problems of soot and ash still remain.

Korean Patent Publication No. 1492333 discloses a natural material candle wick produced from the heart of a stem of Stephanandra incise, and describes that incomplete combustion is able to be suppressed through the natural material candle wick. However, since hydrocarbon-based organic materials are used as a wick material, occurrence of soot and ash may still be a problem, and since physicochemical properties of the natural material are not uniform, and there is wide variation in amounts of soot and ash for each product. Therefore, there is a need to develop a technology in which a length of a wick remaining after combustion is able to be constantly maintained without causing the soot and ash.

SUMMARY

An embodiment of the present invention is directed to providing a wick for a candle including a carbon material, wherein the carbon material is vaporized into carbon dioxide ($CO_2$) gas at the time of combustion, such that a length of the wick is not longer than that of the conventional wick, and a phenomenon in which ash of the wick falls due to the combustion is remarkably reduced, and a candle including the wick for a candle.

Another embodiment of the present invention is directed to providing a wick for a candle in which carbon material is dispersed, wherein the carbon material is vaporized into carbon dioxide gas at the time of combustion, such that the length of the wick is not long, the phenomenon in which soot and ash of the wick fall is reduced, and a tunnel phenomenon in which the candle around the wick is melted down is improved, and a candle including the wick for a candle.

In one general aspect, there is provided a wick for a candle including a carbon material.

The carbon material may be any one or a mixture or a composite of two or more selected from carbon fiber, activated carbon, carbon nanotube, graphite, carbon black, graphene, graphene oxide, a carbon composite material, etc., but is not limited as long as the object of the present invention is achieved.

The carbon material may have a form of any one or two or more selected from long fibers, short fibers, fabrics and particles.

The wick may be selected from the following (i) to (v): (i) a wick formed of the carbon material alone, (ii) a wick in which the carbon material is dispersed in a matrix formed of any one selected from a binder and pulp, or a mixture thereof, (iii) a wick including the carbon material in a fabric formed of any one or two or more fibers selected from natural fibers and synthetic fibers, (iv) a wick including the carbon material in the fabric formed of any one or two or more fibers selected from natural fibers and synthetic fibers, the fabric being coated or impregnated with a binder, and (v) a wick including the carbon material and any one or two or more short fibers selected from short fibers of natural fibers and short fibers of synthetic fibers, in the matrix formed of any one selected from a binder and pulp, or a mixture thereof.

The wick may have a web form including pores in the wick to allow fuel of the candle to be moved by a capillary phenomenon.

The wick for a candle may further include a supporter selected from a wood wick, a zinc wick, a tin wick, and a zinc-tin mixed metal wick.

The binder may have a melting temperature satisfying Equation 1 below:

melting temperature of fuel used in candle <melting temperature of binder. [Equation 1]

The wick may be coated with wax.

The wick for a candle may further include a wick clip.

In another general aspect, there is provided a candle including the wick for a candle as described above.

The candle may include any one or two or more fuels selected from paraffin wax, paraffin oil, soy wax, bees wax, palm wax, gel wax, etc.

The fuel may further include any one or two or more additives selected from fragrance and dye.

DETAILED DESCRIPTION OF MAIN ELEMENTS

Figure 1:
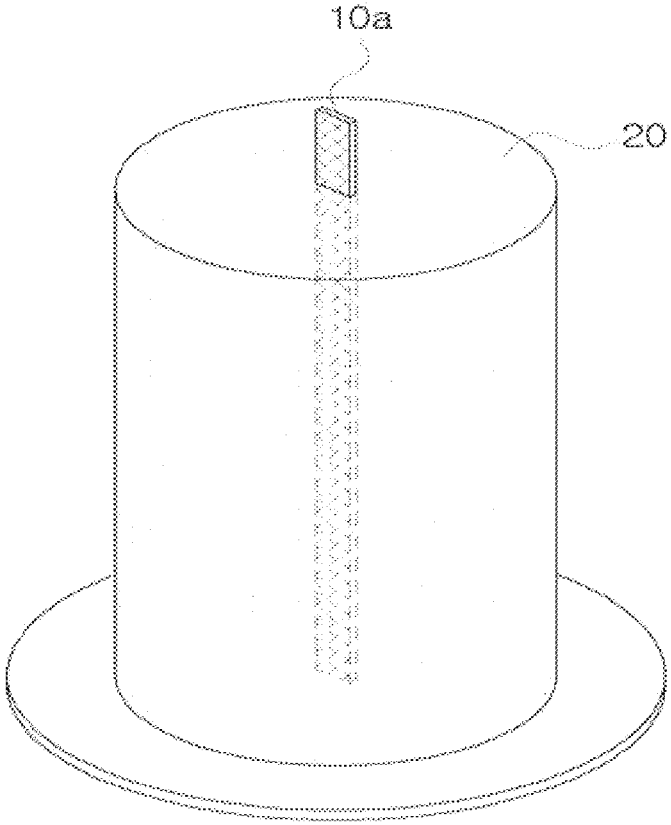
FIG. 1 shows a candle including a plate-shaped wick 10*a* for a candle and a fuel 20 according to an exemplary embodiment of the present invention.

10*a*: plate-shaped wick
10*b*: twisted wick
10*c*: straw-shaped wick woven with diagonal mesh
10*d*: straw-shaped wick woven with straight mesh
20: fuel
200*a*: carbon material particles dispersed in matrix
200*b*: carbon material short fibers dispersed in matrix
200*c*: carbon material long fibers dispersed in matrix
200*d*: matrix formed of pulp
200*e*: matrix formed of fiber

DETAILED DESCRIPTION OF EMBODIMENTS

Hereinafter, the present invention will be described in detail. The present invention may be specifically appreciated by the following Examples, and Examples below are given by way of illustration but are not intended to limit the protective scope defined by the attached claims of the present invention.

A content ratio or a mixing ratio used in the present invention is defined based on a weight of each component unless otherwise defined.

The inventors of the present invention found that when a wick for a candle includes a carbon material, the carbon material is directly vaporized into carbon dioxide ($CO_2$) gas at the time of combustion of the wick, such that soot and ash rarely occur, and completed the present invention.

The present inventor also found that a tunnel phenomenon was able to be suppressed by dispersing the carbon material in a matrix forming the wick, and completed the present invention.

The wick for a candle according to the present invention preferably includes pores in the wick so that fuel of the candle is able to be moved to an upper end portion of the wick by a capillary phenomenon. When the pores are included, the fuel around the wick may be sucked up well and a flame size may be constantly maintained. Further, as the flame of the wick burns, the wick may burn together.

Hereinafter, an exemplary embodiment of the present invention is described in more detail.

An aspect of the present invention relates to a wick for a candle including a carbon material.

In the present invention, the carbon material is a material in which at least 90% constituent atoms are carbon atoms, and thermal resistance, durability and conductivity are excellent due to bonds between carbon and carbon.

In an exemplary embodiment of the present invention, a carbon content of the carbon material is preferably 40 to 100 wt %, more preferably 50 to 100 wt %, based on the total weight of the wick, in order to exhibit an effect of reduced soot and a rare occurrence of ash due to the carbon material, but the carbon content is not limited thereto. That is, when the carbon content is less than 40 wt %, even though the degree of the effect may be reduced, the effect may be exhibited, and thus, the carbon content may be controlled as needed.

In an exemplary embodiment of the present invention, the carbon material may be any one or a mixture or a composite of two or more selected from carbon fiber, activated carbon, carbon nanotube, graphite, carbon black, graphene, graphene oxide, a carbon composite material, etc.

As a specific example, when the carbon material is the carbon fiber, the carbon material may be any one or two or more selected from rayon-based carbon fiber, PAN-based carbon fiber, pitch-based carbon fiber, etc., but is not limited thereto.

The carbon composite material is a material having improved mechanical strength as compared to conventional carbon fibers. For example, the carbon composite material may be a carbon-carbon composite material obtained by impregnating the carbon fiber with a phenolic resin, followed by carbonization and graphitization at a high temperature of 1000 to 2500° C. to increase strength, a silicon carbide (SiC) composite material obtained by using polycarbosilane which is an organic silicon polymer as a precursor, followed by sintering at 800 to 1200° C., or the like, but the present invention is not limited thereto.

According to an exemplary embodiment of the present invention, the carbon material may have a form of any one or two or more selected from long fibers, short fibers, fabrics and particles, and may be included as carbon material dispersion bodies in the wick.

More specifically, an exemplary embodiment of the present invention provides a wick for a candle including a carbon material which is vaporized into carbon dioxide at the time of combustion of the wick wherein pores are included in the wick to allow fuel of the candle to be moved by a capillary phenomenon, and the carbon material is dispersed in a matrix forming the wick.

In an exemplary embodiment of the present invention, the carbon material long fiber may be a long fiber formed of carbon fiber, activated carbon, carbon nanotube, graphite, carbon black, graphene, graphene oxide, a carbon composite material, etc., as described above. A length of the long fiber is not particularly limited as long as it is able to form the wick. As a non-limiting example, the long fiber may have a diameter of 0.01 to 50 μm, preferably of 0.1 to 20 μm. When the above-described range is satisfied, it may be advantageous to produce a fabric including pores, etc.

The carbon material short fiber has an average fiber length shorter than that of the long fiber. As a non-limiting example, the carbon material short fiber may have a diameter of 0.01 to 50 μm, preferably 0.1 to 20 μm, and an average length of 0.01 to 25 mm, preferably 0.1 to 20 mm, and more preferably 1 to 10 mm, but these are not particularly limited as long as it is within a range satisfying physical properties used for the wick. When the above-described range is satisfied, since the carbon material short fibers are well dispersed, the carbon material short fibers may be uniformly mixed with a binder, or the like.

The carbon material fabric may be produced by weaving or electrospinning the carbon material. More specifically, the carbon material fabric may be produced by weaving the carbon material long fiber, or may be woven by mixing the carbon material long fiber with other fibers. In addition, the carbon material fabric may be produced by electrospinning a spinning solution including carbon fiber, activated carbon, carbon nanotube, graphite, carbon black, graphene, graphene oxide, a carbon composite material, etc., and when the carbon material fabric is produced by electrospinning, the carbon material fabric may have a web form including pores with dense micropores formed therein. The electrospinning is not limited as long as it is a method known in the art, and for example, Korean Patent No. 10-1392227, Korean Patent Laid-Open Publication No. 10-2016-0000112, Korean Patent Laid-Open Publication No. 10-2013-0073481, Korean Patent No. 10-0783490, Korean Patent No. 10-1370867, etc., may be referred.

The carbon material particles may be particles of carbon fiber, activated carbon, carbon nanotube, graphite, carbon black, graphene, graphene oxide, a carbon composite material, etc. The 'particle' refers to powder having a finer diameter than that of the short fiber. The carbon material particles may have an average particle diameter of 10 to 5000 nm, preferably 100 to 3000 nm, but the average particle diameter thereof is not particularly limited as long as it is intended to form the wick. When the average particle diameter satisfies the above-described range, it is preferred since the carbon material particles have good dispersibility.

In the present invention, a direction in which the wick is combusted is referred to as a "length direction".

In an aspect of the present invention, in consideration of a shape and a size of the candle to be designed, a length of the wick for a candle with respect to the length direction, and an average diameter or a width of the wick for a candle may be controlled. As an example, the length may be 1 to 50 cm, preferably 3 to 30 cm, and more preferably 5 to 15 cm with respect to the length direction of the wick, but is not limited thereto. In addition, the average diameter or the width of the wick may be 0.01 to 100 mm, preferably 0.1 to 50 mm, and more preferably 0.5 to 20 mm, but is not limited thereto.

Hereinafter, the wick for a candle including the carbon material according to the present invention will be described in detail with reference to the drawings. The accompanying drawings are exemplified to describe an exemplary embodiment of the present invention. The present invention is not limited thereto.

Figure 2:
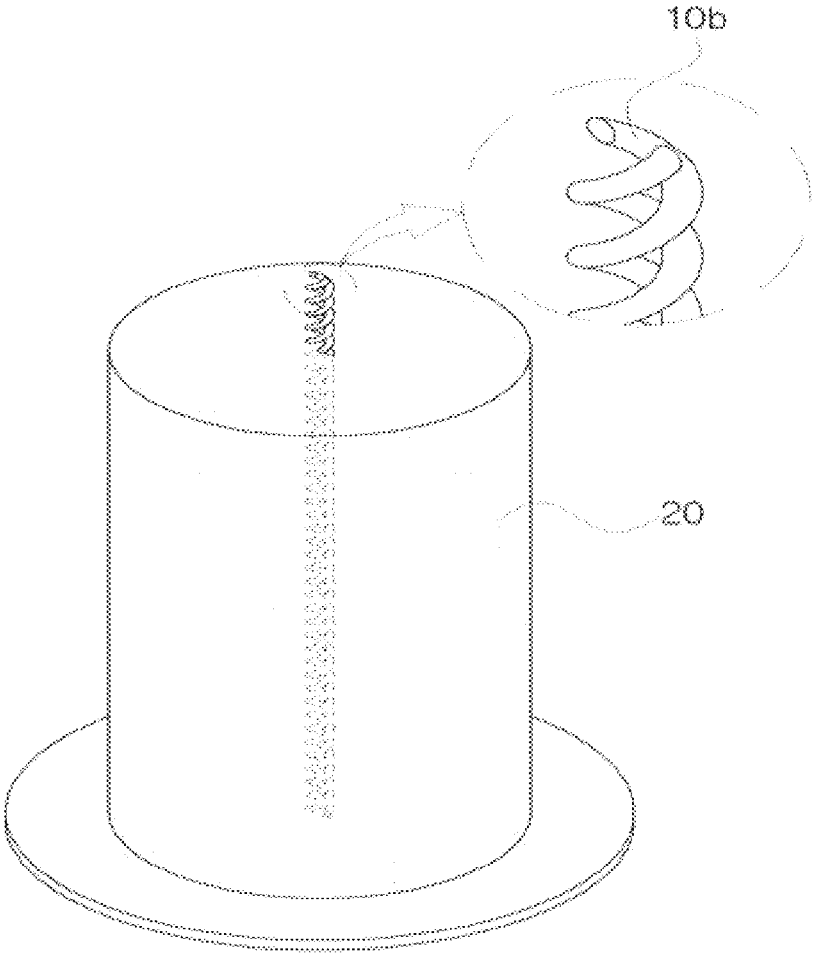
FIG. 2 shows a candle including a twisted wick 10*b* for a candle and a fuel 20 according to an exemplary embodiment of the present invention.
Figure 3:
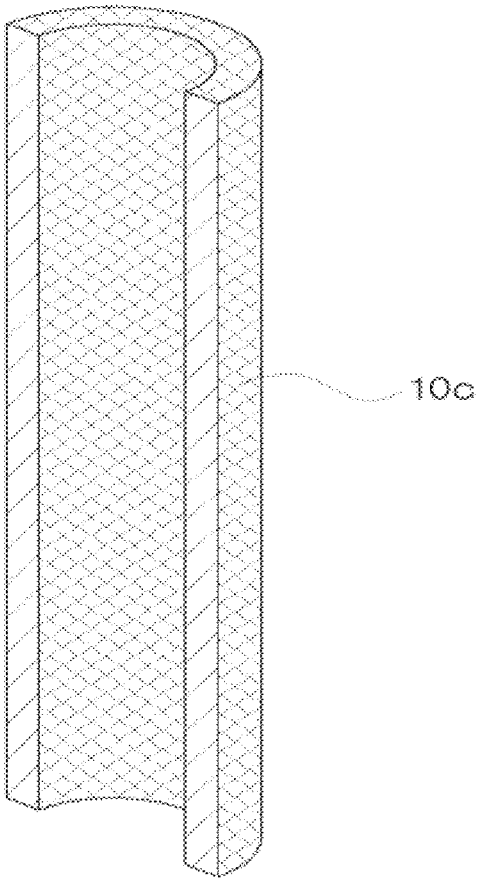
FIG. 3 shows a cross section of a straw-shaped wick woven with a diagonal mesh 10*c* according to an exemplary embodiment of the present invention.
Figure 4:
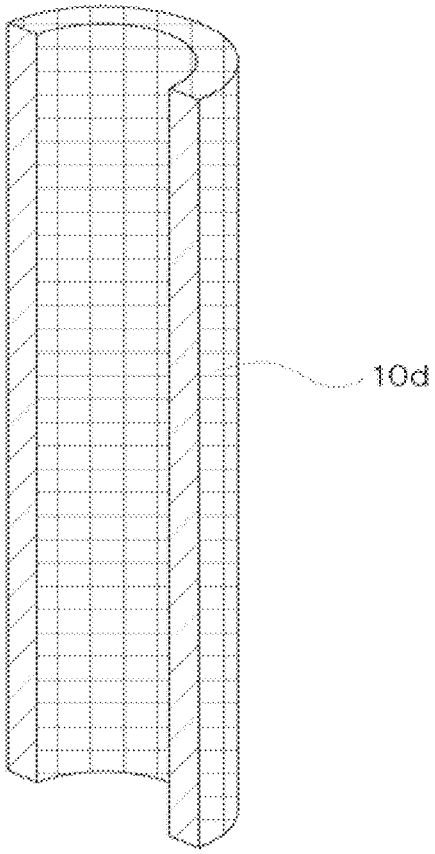
FIG. 4 shows a cross section of a straw-shaped wick woven with a straight mesh 10*d* according to an exemplary embodiment of the present invention.

The wick for a candle in the present invention may be a plate-shaped wick 10*a* as shown in FIG. 1, a twisted wick 10*b* as shown in FIG. 2, and straw-shaped wicks 10*c* and 10*d* as shown in FIGS. 3 and 4, but is not limited thereto.

Specifically, FIG. 1 shows a candle including a plate-shaped wick 10*a* and a fuel 20 according to an exemplary embodiment of the present invention. FIG. 2 shows a candle including a twisted wick 10*b* and a fuel 20 according to an exemplary embodiment of the present invention. At this time, the twisted shape may be produced by crossing two or more fiber bundles as shown in FIG. 2. FIGS. 3 and 4 show cross sections of the straw-shaped wicks 10*c* and 10*d* according to an exemplary embodiment of the present invention. The straw shape means that an inside of a cylinder is empty. FIG. 3 shows the straw-shaped wick woven with a diagonal mesh 10*c* and FIG. 4 shows the straw-shaped wick woven with a straight mesh 10*d*.

The wick for a candle as shown in FIGS. 1 to 4 in an exemplary embodiment of the present invention may be selected from the following (i) to (v): (i) a wick formed of the carbon material alone, (ii) a wick in which the carbon material is dispersed in a matrix formed of any one selected from a binder and pulp, or a mixture thereof, (iii) a wick including the carbon material in a fabric formed of any one or two or more fibers selected from natural fibers and synthetic fibers, (iv) a wick including the carbon material in the fabric formed of any one or two or more fibers selected from natural fibers and synthetic fibers, the fabric being coated or impregnated with a binder, and (v) a wick including the carbon material and any one or two or more short fibers selected from short fibers of natural fibers and short fibers of synthetic fibers, in the matrix formed of any one selected from a binder and pulp, or a mixture thereof.

More specifically, (i) the wick formed of the carbon material alone is described.

The carbon material according to the (i) exemplary embodiment may be any one or a mixture or a composite of two or more selected from carbon fiber, activated carbon, carbon nanotube, graphite, carbon black, graphene, graphene oxide, and a carbon composite material, and the carbon material may have a long fiber form or a fabric form. Specifically, for example, the wick may be a twisted wick made by twisting long fibers formed of the carbon material into several strands. The twisted wick may have the same shape as the wick 10*b* shown in FIG. 2, but is not limited thereto. In addition, the wick may be the straw-shaped wicks (10*c* and 10*d*) made by weaving a fabric including the carbon material into a straw shape as shown in FIGS. 3 and 4. In addition, the wick may be produced by cutting the fabric including the carbon material into the plate shape 10*a* as shown in FIG. 1. Further, the wick may be the straw-shaped wicks (10*c* and 10*d*) made by rolling the fabric including the carbon material as shown in FIGS. 3 and 4.

Next, the (ii) wick in which the carbon material is dispersed in a matrix formed of any one selected from a binder and pulp, or a mixture thereof will be described.

In the (ii) exemplary embodiment, the carbon material having a form of any one or two or more selected from long fibers, short fibers, fabrics and particles may be included in the matrix as a dispersion body. The shape of the wick may be one of the shapes of FIGS. 1 to 4 as described above, but is not limited thereto. When the wick has a plate shape as shown in FIG. 1, the wick may be produced by conventional methods such as spin coating, bar coating, casting, etc., which is not limited to the above-exemplified methods as long as the plate-shaped article may be produced. As shown in FIG. 2, the twisted wick may be produced by cutting the wick formed in a plate form, twisting the wicks, or twisting a plurality of strands of long fiber bundles.

In the (ii) exemplary embodiment, it is preferable to use a matrix material having a low thermal conductivity as the matrix material since high thermal conductivity of the carbon material is reduced to prevent the tunnel phenomenon from occurring. As the carbon material dispersion bodies are dispersed in the matrix, thermal transfer between the carbon material dispersion bodies is reduced and thermal transfer of the matrix material is not performed well, which is more preferred to prevent the tunnel phenomenon in which the fuel of the candle melts around the wick. More preferably, the carbon material dispersion bodies may be spatially spaced apart from each other in the matrix to further reduce thermal transfer.

As a non-limiting example, the matrix material may have thermal conductivity less than 1 W/m·K, preferably less than 0.4 W/m·K, more preferably between 0.01 to 0.2 W/m·K, which is preferred to suppress the tunnel phenomenon.

As a specific example, in the (ii) exemplary embodiment, a case where the matrix is formed of a binder will be described.

In the (ii) exemplary embodiment, the wick may be a wick in which carbon materials in a form of particles are dispersed in a matrix formed of a binder, a wick in which carbon materials in a form of short fibers are dispersed in the matrix formed of a binder, and a wick in which carbon materials in a form of long fibers are dispersed in the matrix formed of a binder.

Figure 5:
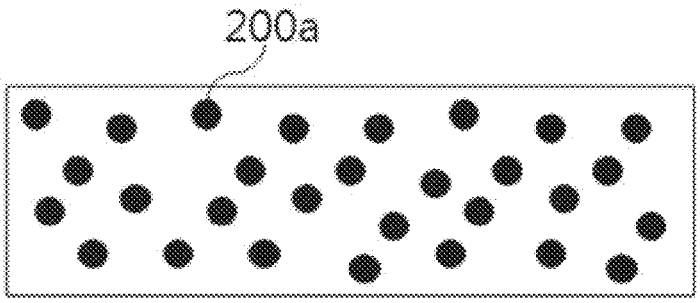
FIG. 5 shows a wick in which carbon material particles 200*a* are dispersed in a matrix formed of a binder according to an exemplary embodiment of the present invention.
Figure 6:
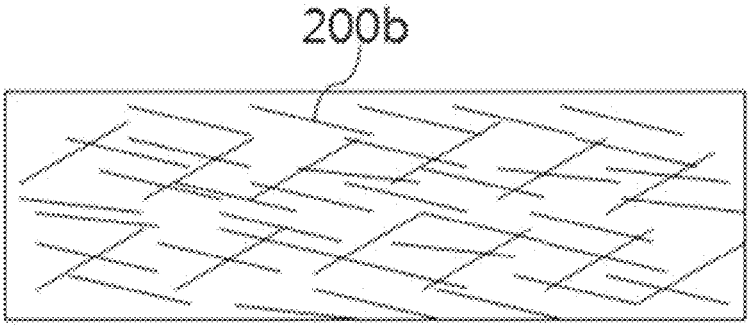
FIG. 6 shows a wick in which carbon material short fibers 200*b* are dispersed in a matrix formed of a binder according to an exemplary embodiment of the present invention.
Figure 7:
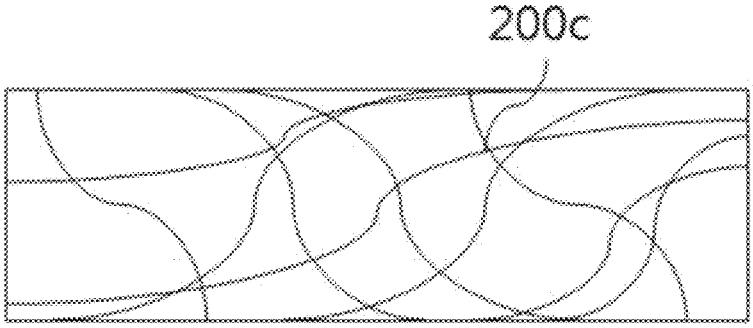
FIG. 7 shows a wick in which carbon material long fibers 200*c* are dispersed in a matrix formed of a binder according to an exemplary embodiment of the present invention.

More specifically, dispersion of the carbon materials is shown in FIGS. 5 to 7. Referring to the drawings, FIG. 5 shows a wick in which carbon material particles 200*a* are dispersed in the matrix formed of the binder. FIG. 6 shows a wick in which carbon material short fibers 200*b* are dispersed in the matrix formed of the binder. FIG. 7 shows a wick in which carbon material long fibers 200*c* are dispersed in the matrix formed of the binder.

In an exemplary embodiment of the present invention, the binder may have a melting temperature satisfying Equation 1 below, which may be applied in the same way in all the following exemplary embodiments.

melting temperature of fuel used in candle<melting temperature of binder. [Equation 1]

When the melting temperature of the binder is higher than that of the fuel, it is preferable since the binder of the wick is not melted and the shape of the wick is able to be maintained as it is. When the melting temperature of the fuel used in the candle is equal to or higher than that of the binder, the binder of the wick may melt due to a temperature of a molten fuel, and the wick may not be maintained in a straight shape.

In an exemplary embodiment of the present invention, the fuel used in the candle may include any one or two or more fuels selected from paraffin wax, soy wax, bees wax, gel wax, etc. The fuel may have a melting temperature of 40 to 70° C.

Further, the binder may include any one or a mixture of two or more selected from a polyamide-based resin, a polyvinyl-based resin, a polyolefin-based resin, a polyester-based resin, an acrylate-based resin, a cellulose-based resin, an epoxy resin, a phenol-based resin, etc., but is not limited thereto. More specifically, the binder may be any one or a mixture of two or more selected from polyvinyl alcohol, polyvinyl pyrrolidone, polyvinyl butyral, polyvinyl acetate, low density polyethylene, linear low density polyethylene, medium density polyethylene, high density polyethylene, polypropylene, ethylene vinyl acetate resin, poly isoprene, nylon 6, nylon 66, polyethylene carbonate, polypropylene polycarbonate, bisphenol A-polycarbonate, polyethylene terephthalate, polybutylene terephthalate, polymethyl methacrylate, methylcellulose, carboxymethylcellulose, epoxy resin, phenol-formaldehyde resin, paraffin, etc.

When the paraffin is used as a binder in an exemplary embodiment of the present invention, the fuel used in the candle may be a fuel having a lower melting temperature than that of paraffin, such as soy wax, etc.

Next, in the (ii) exemplary embodiment, a case where the matrix is formed of pulp will be described.

In the (ii) exemplary embodiment, the wick may be a wick in which carbon materials in a form of particles are dispersed in a matrix formed of pulp, a wick in which carbon materials in a form of short fibers are dispersed in the matrix formed of pulp, and a wick in which carbon materials in a form of long fibers are dispersed in the matrix formed of pulp.

Figure 8:
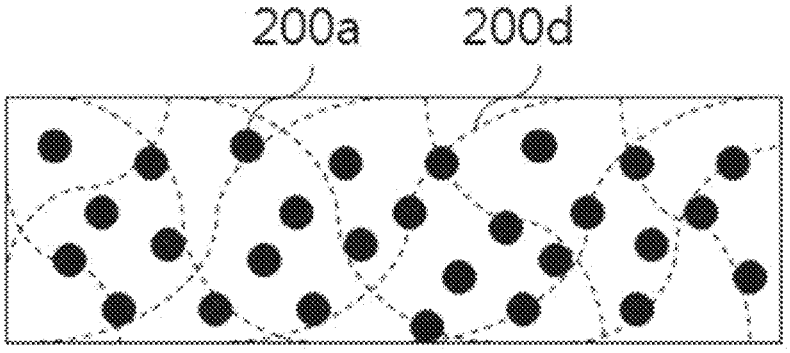
FIG. 8 shows a wick in which carbon material particles 200*a* are dispersed in a matrix formed of pulp 200*d*.
Figure 9:
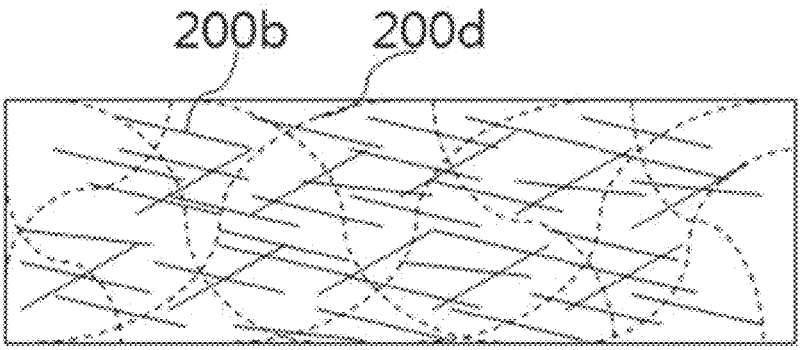
FIG. 9 shows a wick in which carbon material short fibers 200*b* are dispersed in the matrix formed of pulp 200*d*.
Figure 10:
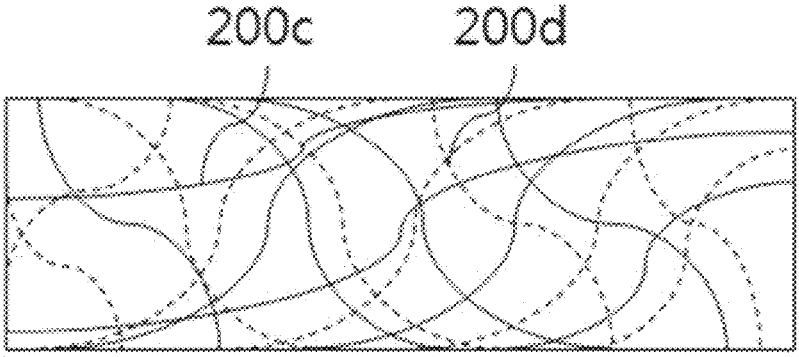
FIG. 10 shows a wick in which carbon material long fibers 200*c* are dispersed in the matrix formed of pulp 200*d*.

More specifically, dispersion of the carbon materials is shown in FIGS. 8 to 10. Referring to the drawings, FIG. 8 shows a wick in which carbon material particles 200*a* are dispersed in a matrix formed of pulp 200*d*. FIG. 9 shows a wick in which carbon material short fibers 200*b* are dispersed in the matrix formed of pulp 200*d*. FIG. 10 shows a wick in which carbon material long fibers 200*c* are dispersed in the matrix formed of pulp 200*d*.

In the present invention, the matrix formed of pulp may maintain a shape and strength of the wick, and twigs of cellulose-based fibers may physically and stably fix the carbon material. At this time, the pulp may be a cellulose-based fiber produced by mechanical pulverization, or by pressure, heat, or chemical treatment of wood or plant fibers.

The pulp is a cellulose-based fiber which is fibrillated to include a number of twigs through mechanical or chemical treatment, wherein a stem branch of the fiber has a diameter of several tens of micrometers (μm), but the twigs connected to the stem branch have a diameter of several micrometers and are complexly connected to each other, and preferably may have a three-dimensional mesh structure. Due to the three-dimensional mesh structure, the pulp and the carbon material particles, the short fibers or the long fibers may be physically coupled to each other or entangled with each other and may be dispersed in a stable form in the mesh structure of the pulp without special treatment to form a wick having high porosity.

As a non-limiting specific example, the pulp may be wood pulp such as hardwood such as birch, eucalyptus, oak, etc., and softwood such as pine, fir, etc., or non-wood pulp including plant fiber such as straw, cotton, bark of paper mulberry, etc., as raw materials.

As a non-limiting example, the pulp may have an average fiber length of 0.1 to 20 mm, preferably 0.5 to 10 mm. When the average fiber length of the pulp satisfies the above-described range, it is preferable in that the shape and strength of the wick may be maintained, and the twigs of the cellulose-based fiber may fix the carbon material physically and stably.

In addition, in the (ii) exemplary embodiment, a case where the matrix is formed of a mixture of a binder and pulp will be described.

In the (ii) exemplary embodiment, when the mixture of the binder and pulp is used as the matrix, a mixing ratio of the binder and the pulp may be a weight ratio of 1:9 to 9:1, preferably 2:8 to 4:6, but is not limited thereto. When the mixing ratio satisfies the above-described range, it is preferred that the binder and the pulp may be effectively mixed, rigidity of the fibers included in the pulp may be further improved by the binder, and thus rigidity of the wick may be improved to maintain the shape of the wick. Further, the carbon material is strongly coupled by the binder, and the carbon material coupled by the binder is fixed to the twigs of the cellulose-based fiber present in the pulp, which may be particularly preferable in that it is possible to have a high porosity and a strong binding strength.

As a specific example, a mixing ratio of any one selected from the binder and the pulp or a mixture thereof and the carbon material may be a weight ratio of 10:90 to 90:10, more preferably a weight ratio of 15:85 to 85:15, and more preferably 45:55 to 55:45, but is not limited thereto. When the mixing ratio satisfies the above-described range, it is preferred that the carbon material may be fixed in the matrix to thereby prevent the carbon material from being separated, to maintain the shape of the wick, and to effective suppress formation of soot and ash due to a high carbon material content.

As a non-limiting example, the wick according to the (ii) exemplary embodiment may be formed of a plate-shaped sheet including carbon material short fibers, pulp and a binder, wherein the pulp is a fibrillated cellulose-based fiber having a three-dimensional mesh structure, and the carbon material short fibers may be dispersed in the wick.

Next, (iii) the wick including the carbon material in fabric formed of any one or two or more fibers selected from natural fibers and synthetic fibers will be described.

The wick of the (iii) exemplary embodiment may be produced in a plate shape, a twisted shape and a straw shape as shown in FIGS. 1 to 4, but the shape of the wick is not limited thereto.

In the (iii) exemplary embodiment, the natural fiber may be any one or two or more mixed fibers selected from cotton, hemp, silk, wool, etc., but is not limited thereto. The synthetic fiber may be any one or two or more mixed fibers selected from polyamide-based fiber, polyolefin-based fiber, polyester-based fiber, polyvinyl alcohol-based fiber, polyacrylate-based fiber and polyurethane fiber, etc., and may be a copolymer fiber produced through copolymerization with a comonomer. Preferably, the fiber may be nylon 6 fiber, nylon 66 fiber, polyethylene fiber, polypropylene fiber, polyethylene terephthalate fiber, polybutylene terephthalate fiber, polyvinyl alcohol fiber, polyacrylonitrile fiber, poly (vinyl chloride-co-acrylonitrile) or butanediol-derived polyurethane fiber, etc., but is not limited thereto.

In the (iii) exemplary embodiment, the carbon material included in the fabric may have a form of any one or two or more selected from long fibers, short fibers, fabrics and particles.

Figure 11:
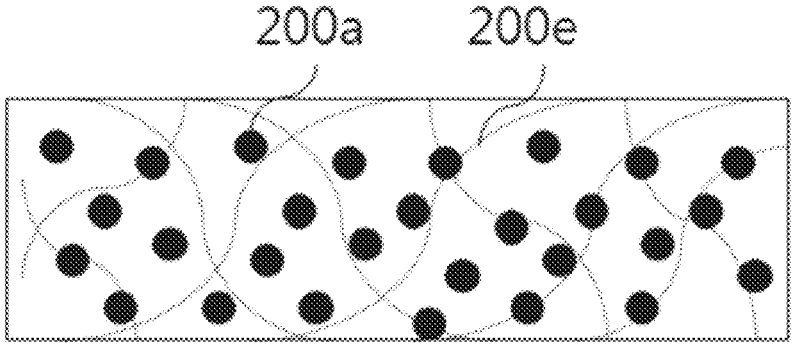
FIG. 11 shows a wick in which carbon material particles 200*a* are dispersed in a fabric formed of fibers 200*e*.
Figure 12:
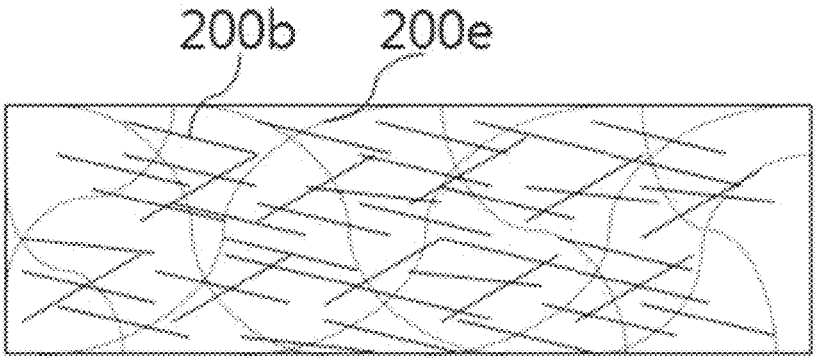
FIG. 12 shows a wick in which carbon material short fibers 200*b* are dispersed in the fabric formed of fibers 200*e*.
Figure 13:
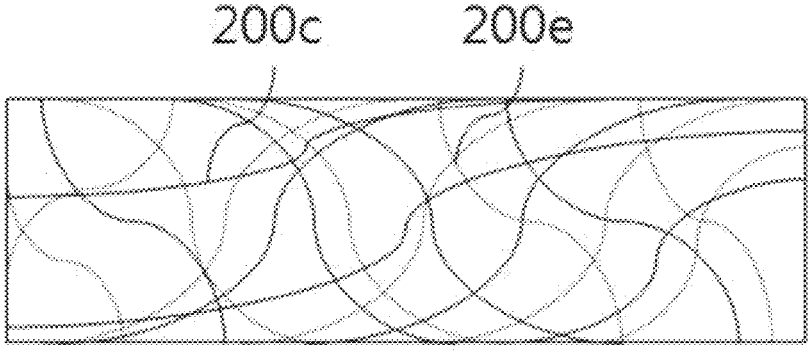
FIG. 13 shows a wick in which carbon material long fibers 200*c* are dispersed in the fabric formed of fibers 200*e*.

An exemplary embodiment thereof is shown in FIGS. 11 to 13. Referring to the drawings, FIG. 11 shows a wick in which carbon material particles 200*a* are dispersed in a fabric 200*e* formed of any one or two or more fibers selected from natural fibers and synthetic fibers. FIG. 12 shows a wick in which the carbon material short fibers 200*b* are dispersed in the fabric 200*e*. FIG. 13 shows a wick in which the carbon material long fibers 200*c* are dispersed in the fabric 200*e*. In FIG. 13, the fabric may be produced by weaving the carbon material in a long fiber form and any one or two or more fibers selected from natural fibers and synthetic fibers.

In the (iii) exemplary embodiment, the dispersion may be performed by blowing at high pressure or by spraying to physically fix the carbon material. Preferably, it is particularly preferable to disperse the carbon material particles or the carbon material short fibers on a surface of the fiber by blowing or spraying, followed by annealing at a glass transition temperature or higher of the polymer constituting the fiber for a predetermined time to perform physical binding, and thus, the carbon material particles or the carbon material short fibers may have strong binding strength without being separated from the fiber. Time for annealing may be at least 2 minutes, preferably 5 minutes to 60 minutes, but may vary depending on the type and diameter of the fiber, and is not limited thereto.

In the (iii) exemplary embodiment, a content of the carbon material may be 50 to 90 wt %, preferably 55 to 85 wt % based on the total weight of the wick, but is not particularly limited as long as the object of the present invention is achieved. When the content thereof satisfies the above-described range, it is preferable since it is possible to minimize soot and ash of the wick at the time of combustion.

Next, (iv) the wick including the carbon material in the fabric formed of any one or two or more fibers selected from natural fibers and synthetic fibers, the fabric being coated or impregnated with a binder will be described.

The wick of the (iv) exemplary embodiment may be produced in a plate shape, a twisted shape and a straw shape as shown in FIGS. 1 to 4, but the shape of the wick is not limited thereto.

Further, the wick may be a wick in which the wick of the (iii) exemplary embodiments shown in FIGS. 11 to 13 is applied or impregnated with a binder, and further drawings thereof are not provided.

In the (iv) exemplary embodiment, it is preferable that a content of the binder may be preferably 1 to 20 parts by weight, and more preferably 5 to 15 parts by weight, based on 100 parts by weight of the fabric including the carbon material. By further applying or impregnating the wick with the binder, the rigidity of the wick may be further improved, and the carbon material physically fixed to the surface of the fiber may be coupled more strongly by the application or impregnation of the binder.

The (iv) exemplary embodiment is preferable in that it is possible to have porosity due to the distance between fibers and to have a strong binding strength by the binder at the same time. Here, the binder may have the same components as the above-described binder.

The method of applying or impregnating in the (iv) exemplary embodiment is not particularly limited, but may include a spray coating method, a dip coating method, a painting method, etc., known in the art, and is not limited as long as it is a method of applying the surface of the fiber with a binder.

Next, (v) the wick including the carbon material and any one or two or more short fibers selected from short fibers of natural fibers and short fibers of synthetic fibers, in the matrix formed of any one selected from a binder and a pulp, or a mixture thereof will be described.

The wick of the (v) exemplary embodiment may be produced in a plate shape, a twisted shape and a straw shape as shown in FIGS. 1 to 4, but the shape of the wick is not limited thereto.

In the (v) exemplary embodiment, the wick may further include any one or two or more short fibers selected from short fibers of natural fibers and short fibers of synthetic fibers when producing the wick of the (ii) exemplary embodiment, and separate drawings are omitted.

The (v) exemplary embodiment will be described in detail. The wick may be a wick in which carbon material particles and short fibers of natural fibers are dispersed in a matrix formed of a binder, a wick in which carbon material short fibers and the short fibers of natural fibers are dispersed in the matrix formed of a binder, and a wick in which carbon material long fibers and the short fibers of natural fibers are dispersed in the matrix formed of a binder. In addition, the wick may be a wick in which carbon material particles and short fibers of natural fibers are dispersed in a matrix formed of pulp, a wick in which carbon material short fibers and the short fibers of natural fibers are dispersed in the matrix formed of pulp, and a wick in which carbon material long fibers and the short fibers of natural fibers are dispersed in the matrix formed of pulp.

In the (v) exemplary embodiment, any one or two or more short fibers selected from the short fibers of the natural fibers and the short fibers of synthetic fibers are used in a content of 0.1 to 20 parts by weight, preferably 1 to 10 parts by weight, based on 100 parts by weight of the wick of the (ii) exemplary embodiment, but the content is not particularly limited as long as the object of the invention is achieved. When the content thereof satisfies the above-described range, it is preferable since it is possible to maximize the porosity while minimizing soot and ash of the wick at the time of combustion.

In the (v) exemplary embodiment, the short fibers of the natural fibers and the short fibers of the synthetic fibers may preferably have an average length of 0.01 to 25 mm, preferably 0.1 to 20 mm, and more preferably 1 to 10 mm. Within the above-described range, the fibers may be effectively dispersed in the matrix together with the carbon material. By including the short fibers of the natural fibers or the synthetic fibers in the matrix, the porosity of the wick may be further improved and the porosity per unit volume of the wick may be improved.

According to an exemplary embodiment of the present invention, it is preferred that the wick for a candle has a web form including pores in the wick so that the fuel of the candle may be moved to the upper end portion of the wick by a capillary phenomenon. Here, the fuel of the candle may be a fuel in which a solid fuel of the candle is melted to be a liquid state at the time of combustion, or a liquid fuel such as paraffin oil, or the like. The wick may allow the molten solid fuel or liquid fuel of the candle to be moved to the upper end portion of the wick by a capillary phenomenon. The web form means that the fibers or particles are entangled with each other to include pores. Since there are a number of fine pores of the wick, heat shielding performance may be excellent to reduce thermal conductivity of the carbon material included in the wick.

It is preferable that the pores of the wick may have a porosity of 40 to 90 wt %, preferably 50 to 80 wt %, based on the total volume of the entire wick. In addition, as an example, the pores of the wick may have a size of 1 nm to 1000 μm, preferably 100 nm to 500 μm in diameter. When the size of the pores of the wick satisfies the above-described range, a physical form of the wick may be maintained, thermal conductivity of the wick may be reduced, and the fuel of the candle may be moved by the capillary phenomenon at the time of combustion of the candle, thereby maintaining flame.

According to an exemplary embodiment of the present invention, the wick for a candle may further include a supporter selected from a wood wick, a zinc wick, a tin wick, a zinc-tin mixed metal wick, etc. Preferably, the use of the zinc wick is safe at the time of combustion, and is preferable in that since zinc may be vaporized within a flame temperature, but it is not particularly limited as long as the object of the present invention is achieved. When the supporter is included, it is possible to prevent the wick from being bent when the tunnel phenomenon occurs due to melting of the fuel of the candle at the time of combustion.

Regarding the supporter, at least one supporter may be inserted into the insde of the wick, or at least any one supporter may be coupled to at least one surface of the wick. Here, the wick may further include an adhesive. The adhesive may increase a binding strength between the wick and the supporter. The adhesive may have the same component as the above-described binder.

For example, the supporter may have a plate shape, a strip shape, a flat plate strip shape, a wire shape, a bar shape, etc. Specifically, the wood wick may have a strip shape, a flat plate strip shape and a bar shape, and the zinc, tin and zinc-tin mixed metal wick may have a wire shape.

As a specific example, a wire-shaped zinc wick supporter may be inserted into the inside of the twisted wick, or a plate-shaped wood wick supporter may be coupled with the plate-shaped wick, wherein a coupled configuration may be made in the manner in which surface-to-surface of the plates is coupled in the same length direction as the length direction of the wick, but is not limited thereto.

In addition, the supporter may have an appropriate length in consideration of the shape and size of the wick to be designed. As an example, the length of the supporter may be 1 to 50 cm, preferably 5 to 30 cm, and more preferably 5 to 15 cm, but is not limited thereto. In addition, the average diameter or width of the supporter may be 0.001 to 50 mm, specifically 0.1 to 10 mm, but is not limited thereto.

According to an exemplary embodiment of the present invention, the wick for a candle may be coated with wax. As a specific example, the coating may be performed by using any one method selected from dip coating in which the wick is immersed into a molten wax, dry coating, laminating, spraying methods, and the like. The method for coating is not limited as long as it is any coating method known in the art.

As a specific example, the wax may be any one or a mixture of two or more selected from paraffin wax, bees wax, soy wax, palm wax, gel wax, etc., but is not limited thereto.

The wick coated with wax may allow initial ignition of the wick to be effectively generated by using the wax as fuel at the time of combustion. Further, the wick coated with wax is preferable in that it is possible to maintain a stiff and straight state, and to prevent the tunnel phenomenon due to thermal transfer at the time of combustion.

According to an exemplary embodiment of the present invention, the wick may further include a wick clip. The wick clip may fix the wick vertically. A shape of the wick clip is not particularly limited, and may be various shapes such as circle, triangle, square, a clip shape, etc., depending on the purpose.

According to another embodiment of the present invention, there is provided a candle including the wick. In the present invention, the candle may include a fuel. The fuel may be a solid fuel or a liquid fuel. Here, the fuel may enclose the wick of the candle. A position of the wick is not particularly limited, but it is preferable that the wick is positioned at the center of the candle. When the wick is positioned at the center of the candle, it is preferable in that a flame of the wick may uniformly melt the fuel at the time of combustion of the candle. The fuel of the candle may be raised by the capillary phenomenon of the wick, thereby maintaining the combustion of the wick.

As a specific example, the fuel of the candle may be any one or a mixture of two or more selected from paraffin wax, paraffin oil, bees wax, soy wax, palm wax, gel wax, etc., but is not limited thereto.

According to the exemplary embodiment of the present invention, the fuel of the candle may further contain one or two or more additives selected from perfumes and dyes. It is preferred that the perfume and the dye are not harmful to the human body.

A specific example of the perfume may include fragrance oil corresponding to artificial perfume and/or natural essential oil extracted from plant, but is not limited thereto. As a more specific example, the perfume may be one or two or more selected from perfumes of lavender, rosemary, jasmine, chamomile, rose, geranium, lily, daisy, lemon, cinnamon, eucalyptus, bergamot, peach, etc.

As a specific example, the perfume may be included in a content of 0.1 to 10 parts by weight, preferably, 1 to 5 parts by weight, based on 100 parts by weight of the candle, but is not limited thereto. When the content of the perfume satisfies the above-described range, it is preferred since the candle may emit subtle fragrance at the time of combustion.

The dye is not particularly limited, but a dye having a suitable color may be selected depending on the object. As an example, the dye is a dye for a candle that is not harmful. As a specific example, the dye may have one or two or more colors selected from red, yellow, green, orange, purple, pink, brown, etc.

As a specific example, the dye may be contained in a content of 0.1 to 10 parts by weight, preferably, 1 to 5 parts by weight, based on 100 parts by weight of the candle (the fuel of the candle), but is not limited thereto. When the content of the dye satisfies the above-described range, it is preferred since a color of the candle may be exhibited.

According to the exemplary embodiment of the present invention, the candle may have various sizes and shapes depending on the object, and is not particularly limited. As a specific example, the candle may have any one or two or more selected from a cylindrical shape, a tetragonal shape, a triangular shape, a pentagonal shape, a hexagonal shape, a heart shape, a star shape, etc.

Hereinafter, the carbon material wick for a candle and the candle including the same according to the present invention will be described in more detail through Examples. However, the following Examples are only references for specifically explaining the present invention, but the present invention is not limited thereto and may be implemented in various forms.

In addition, unless defined otherwise, all technical and scientific terms used herein have the same meanings generally understood by those skilled in the art to which the present invention pertains. Terms used in the specification of the present invention are to effectively describe specific exemplary embodiments, but are not intended to limit the present invention.

In addition, the drawings to be described below are provided by way of example so that the idea of the present invention can be sufficiently transferred to those skilled in the art to which the present invention pertains. Therefore, the present invention may be implemented in many different forms, without being limited to the drawings to be described below. The drawings to be provided below may be exaggerated in order to specify the spirit of the present invention.

It is intended that singular forms used in the specification and claims include plural forms unless otherwise indicated in the context.

EXAMPLE 1

40 wt % of an aqueous solution containing 50 wt % of polyvinyl alcohol (Sigma-Aldrich Co., weight average molecular weight of 31,000 to 50,000 g/mol, 98 to 99% hydrolyzed, melting point of 200° C.) was mixed with 60wt % of wood pulp having an average length of 5 mm.

70 wt % of the mixture was mixed with 30 wt % of short fibers of activated carbon fiber having an average length of 3 mm, followed by casting on a flat plate with a frame to manufacture a sheet having a thickness of 0.3 mm. The manufactured sheet was dried at 25° C. for 36 hours. The dried sheet was cut into a size of 2 mm×7 cm (width ×length) to produce a wick. After melting paraffin wax having a melting point of 61° C. by raising a temperature to the melting point, the wick was immersed in the melted solution to coat the paraffin wax on a surface of the wick.

A wick clip was inserted into one side of the coated wick, and the wick was put into a heat resistant glass bottle having a diameter of 7 cm and a length of 8.5 cm. The wick was placed perpendicular to the bottom of a glass bottle.

200 g of paraffin wax having a melting point of 61° C. was warmed, and then placed in a glass container to produce a candle having a height of 6.5 cm. The candle was allowed to stand at 25° C. for 24 hours to thereby be completely hardened and the wick of the candle was cut into a size of 5 mm to produce a candle.

EXAMPLE 2

A candle was produced in the same manner as in Example 1 except that 50 wt % of the mixture was mixed with 50 wt % of the short fibers of activated carbon fiber having an average length of 3 mm.

EXAMPLE 3

A candle was produced in the same manner as in Example 1 except that 10 wt % of the mixture was mixed with 90 wt % of the short fibers of activated carbon fiber having an average length of 3 mm.

EXAMPLE 4

The sheet of Example 1 was cut into a size of 1 mm×20 cm (width×length), and three cut strands were twisted at regular intervals as shown in FIG. 2, thereby producing a twisted wick. The wick had a diameter of 2 mm and a length of 7 cm. The wick was coated with paraffin wax in the same manner as in Example 1, and then a candle was produced.

EXAMPLE 5

A sheet cut into a size of 1 mm×50 cm (width×length) from the sheet of Example 1 was wound diagonally on a wooden bar having a diameter of 2 mm and wound one more time in the other direction, thereby producing a diagonal shaped fabric as shown in FIG. 3. Then, the fabric was immersed in an aqueous solution containing 50 wt % of polyvinyl alcohol (Sigma-Aldrich Co., weight average molecular weight 31,000 to 50,000 g/mol, 98 to 99% hydrolyzed, melting point of 200° C.), taken out, and dried at 25° C. for 24 hours. Then, the central wooden bar was removed to produce a straw-shaped wick as shown in FIG. 3. The wick had an external diameter of 3 mm and an internal diameter of 2 mm. The wick was coated with paraffin wax in the same manner as in Example 1, and then a candle was produced.

EXAMPLE 6

Natural fibers of cotton having an average diameter of 30 μm and rayon-based carbon fibers having an average diameter of 20 μm were mixed at a weight ratio of 1:1 to produce a fabric. The fabric was cut into a size of 2 mm×7 cm (width×length) to produce a wick. After melting paraffin wax having a melting point of 61° C. by raising a temperature to the melting point, the wick was immersed in the melted solution to coat the paraffin wax on a surface of the wick. A candle was produced in the same manner as in Example 1 by using the wick.

EXAMPLE 7

Fiber bundles obtained by mixing natural fibers of cotton having an average diameter of 30 μtm and pitch-based carbon fibers having an average diameter of 30 μm at a weight ratio of 1:1 were twisted at regular intervals to produce a twisted wick as shown in FIG. 2. The wick was coated with paraffin wax in the same manner as in Example 1, and then a candle was produced.

EXAMPLE 8

Natural fibers of cotton having an average diameter of 30 μm and rayon-based carbon fibers having an average diameter of 20 μm were mixed at a weight ratio of 1:1 to produce a fabric. The fabric was cut into a size of 2 mm×7 cm (width×length) to produce a wick.

The wick was immersed in an aqueous solution containing 50 wt % of polyvinyl alcohol (Sigma-Aldrich Co., weight average molecular weight 31,000 to 50,000 g/mol, 98 to 99% hydrolyzed, melting point of 200° C.) for 10 seconds and then taken out to be impregnated with the polyvinyl alcohol resin.

The wick was coated with paraffin wax in the same manner as in Example 1, and then a candle was produced.

EXAMPLE 9

70 wt % of short fibers of activated carbon fiber having an average length of 3 mm was mixed with 30 wt % of wood pulp having an average length of 5 mm. 10 parts by weight of the short fibers of natural fibers of cotton having an average diameter of 100 μm and an average length of 10 mm were added and mixed with 20 parts by weight of an aqueous solution containing 50 wt % of polyvinyl alcohol (Sigma-Aldrich Co., weight average molecular weight of 31,000 to 50,000 g/mol, 98 to 99% hydrolyzed, melting point of 200° C.), based on 100 parts by weight of the mixture, followed by casting on a flat plate with a frame to manufacture a sheet having a thickness of 0.3 mm. The manufactured sheet was dried at 25° C. for 36 hours. The dried sheet was cut into a size of 2 mm×7 cm (width×length) to produce a wick. After melting paraffin wax having a melting point of 61° C. by raising a temperature to the melting point, the wick was immersed in the melted solution to coat the paraffin wax on a surface of the wick.

A candle was produced in the same manner as in Example 1 by using the wick.

EXAMPLE 10

A wick was produced by using a zinc wick having a diameter of 0.5 mm and a length of 7 cm as a core while using the wick of Example 3, and the produced wick had a diameter of 2.5 mm. All processes were performed in the same manner as in Example 1, except that the wick as produced above was used.

EXAMPLE 11

20 parts by weight of an aqueous solution containing 50 wt % of polyvinyl alcohol (Sigma-Aldrich Co., weight average molecular weight of 31,000 to 50,000 g/mol, 98 to 99% hydrolyzed, melting point of 200° C.) was added and mixed with respect to 100 parts by weight of the short fibers of activated carbon fiber having an average length of 3 mm, followed by casting on a flat plate with a frame to manufacture a sheet having a thickness of 0.3 mm. The manufactured sheet was dried at 25° C. for 36 hours. The dried sheet was cut into a size of 2 mm ×7 cm (width×length) to produce a wick. After melting paraffin wax having a melting point of 61° C. by raising a temperature to the melting point, the wick was immersed in the melted solution to coat the paraffin wax on a surface of the wick.

A candle was produced in the same manner as in Example 1 by using the wick.

As a result of combustion of the wick of the produced candle, soot and ash did not occur within 2 hours after the combustion, and the wick was combusted down together with the flame, but the combustion was not possible after 2 hours or longer due to the tunnel phenomenon in which the candle around the wick was melted down.

COMPARATIVE EXAMPLE 1

All processes were performed in the same manner as in Example 1, except that a cotton wick (No. 3, Korea) was used as the wick.

COMPARATIVE EXAMPLE 2

All processes were performed in the same manner as in Example 1, except that a smokeless wick (No. 3, Korea) was used as the wick.

COMPARATIVE EXAMPLE 3

A wood wick having a thickness of 1 mm, a width of 1 cm and a length of 7 cm was inserted into a wick clip and used as the wick. The wick was placed perpendicular to the bottom of a glass bottle with the wick clip. 200 g of paraffin wax having a melting point of 61° C. was warmed, and then placed in a glass container to produce a candle having a height of 6.5 cm. The candle was allowed to stand at 25° C. for 24 hours to produce a fully hardened candle.

TEST EXAMPLE 1

The candles produced in Examples 1 to 11 and Comparative Examples 1 to 3 were combusted for 5 hours to evaluate a change in wick over time.

○: The wick was combusted down together with the flame.

Δ: The wick was combusted in a state in which a length of the wick was extended 3 to 5 mm from the top of wax.

×: The wick was combusted in a state in which a length of the wick was extended 5 mm or longer from the top of wax.

TABLE 1

| | Change in wick | | | | |
|---|---|---|---|---|---|
| | 1 hr | 2 hr | 3 hr | 4 hr | 5 hr |
| Example 1 | ○ | ○ | ○ | Δ | Δ |
| Example 2 | ○ | ○ | ○ | ○ | Δ |
| Example 3 | ○ | ○ | ○ | ○ | ○ |
| Example 4 | ○ | ○ | ○ | Δ | Δ |
| Example 5 | ○ | ○ | ○ | Δ | Δ |
| Example 6 | ○ | ○ | Δ | Δ | Δ |
| Example 7 | ○ | ○ | Δ | Δ | Δ |
| Example 8 | ○ | ○ | Δ | Δ | Δ |
| Example 9 | ○ | ○ | ○ | Δ | Δ |
| Example 10 | ○ | ○ | ○ | Δ | Δ |
| Example 11 | ○ | ○ | — | — | — |
| Comparative Example 1 | Δ | Δ | x | x | x |
| Comparative Example 2 | ○ | Δ | x | x | x |
| Comparative Example 3 | ○ | Δ | x | x | x |

Table 1 shows evaluation results of the change in the wick for a candle of over time for each sample. According to Table 1, it could be confirmed that in Examples 1 to 10, the wick was combusted together with flame or the length of the wick was slightly longer over time. In Example 11, it was confirmed that the wick was combusted together with the flame, but the combustion was not possible after 2 hours or longer since the tunnel phenomenon occurred.

In Comparative Example 1, the commercially available cotton wick was used, and it was confirmed that the length of the wick combusted over time was excessively long, i.e., 5 mm or more. In Comparative Example 2, the commercially available smokeless wick was used, and it was confirmed that the combusted wick remained long over time. In Comparative Example 3, the wood wick was used, and it was confirmed that the combusted wick remained long over time.

Figure 14:
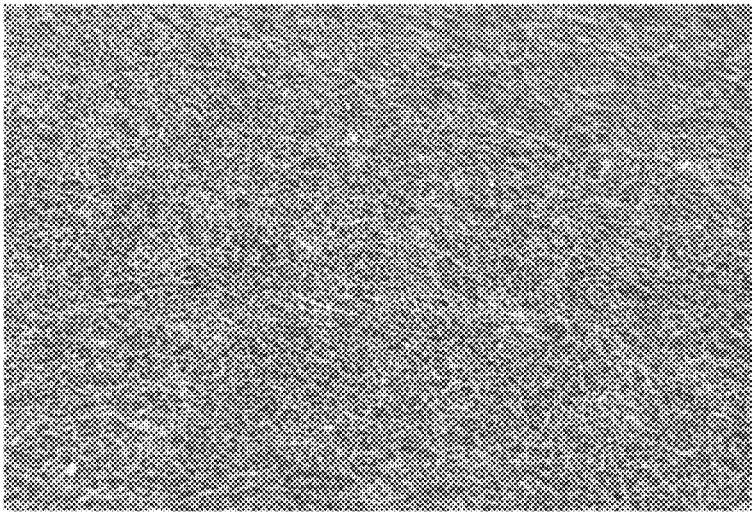
FIG. 14 is an image of a sheet including a carbon material according to an exemplary embodiment of the present invention.
Figure 15:
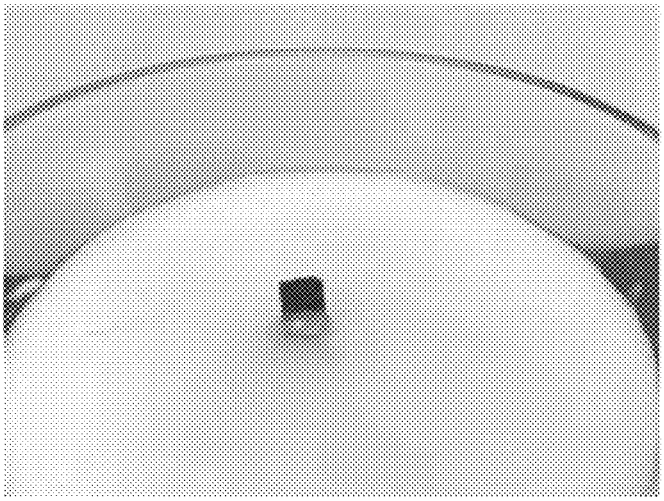
FIG. 15 is a front view showing a candle according to an exemplary embodiment of the present invention.
Figure 16:
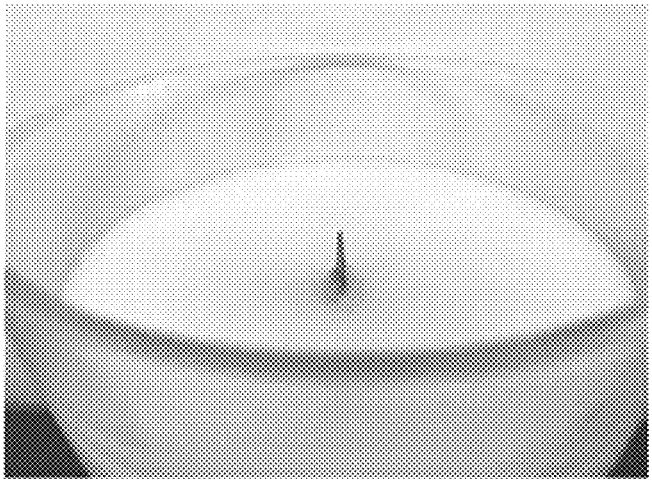
FIG. 16 is a side view showing a candle according to an exemplary embodiment of the present invention.

An image of the sheet produced in Example 1 is shown in FIG. 14. As shown in FIG. 14, pulp and carbon material short fibers formed a matrix. The porosity was measured according to ASTM D-6226 method. It was found that the porosity was 62%, and thus, a number of fine pores were included, as measured using a porosity measuring apparatus (ULTRAFOAM 1200e of Quantachrome Instruments). Further, images of the candles including the wicks produced by cutting the manufactured sheet were shown in FIGS. 15 to 16. FIG. 15 is a front view of the candle, and FIG. 16 is a side view of the candle.

TEST EXAMPLE 2

The candle samples produced in Examples 1 to 11 and Comparative Examples 1 to 3 were combusted for 5 hours to evaluate occurrence of soot and ash over time.

○: Soot and ash rarely occurred.

Δ: A small amount of soot or ash occurred.

×: A large amount of soot and ash occurred.

TABLE 2

| | Occurrence of soot and ash | | | | |
|---|---|---|---|---|---|
| | 1 hr | 2 hr | 3 hr | 4 hr | 5 hr |
| Example 1 | ○ | ○ | ○ | ○ | Δ |
| Example 2 | ○ | ○ | ○ | ○ | Δ |
| Example 3 | ○ | ○ | ○ | ○ | ○ |
| Example 4 | ○ | ○ | ○ | Δ | Δ |
| Example 5 | ○ | ○ | ○ | Δ | Δ |
| Example 6 | ○ | ○ | Δ | Δ | Δ |
| Example 7 | ○ | ○ | Δ | Δ | Δ |
| Example 8 | ○ | ○ | Δ | Δ | Δ |
| Example 9 | ○ | ○ | ○ | Δ | Δ |
| Example 10 | ○ | ○ | ○ | Δ | Δ |
| Example 11 | ○ | ○ | — | — | — |
| Comparative Example 1 | Δ | x | x | x | x |
| Comparative Example 2 | ○ | Δ | x | x | x |
| Comparative Example 3 | ○ | Δ | x | x | x |

Table 2 shows evaluation results of occurrence of soot and ash for each sample. As shown in Table 2, it was confirmed that in the wicks of Examples 1 to 5 and Examples 9 and 10, little or only a small amount of smoke, soot and ash occurred at the time of combustion for 3 hours or more. It could be confirmed that in the wicks of Examples 6 to 8, some smoke occurred at the time of combustion for 2 hours or longer, but soot and ash did not remain black. In the wick of Example 11, soot and ash did not occur at the time of combustion for 2 hours or longer, but the combustion was not possible after 2 hours or longer due to the tunnel phenomenon.

In the wicks of Comparative Examples 1 to 3, it could be confirmed that soot and ash did not occur in a large amount at an initial stage, but soot and ash excessively occurred over time at the time of combustion for 1 hour or more. It could be confirmed that in the wood wick of Comparative Example 3, black smoke occurred at the time of combustion, and soot also occurred very seriously over time.

Since the wick for the candle according to the present invention includes the carbon material, the length of the wick is not longer than that of the conventional wick after combustion, and thus, it is convenient to use the wick for the candle since it is not required to cut the wick separately.

Further, the phenomenon in which the ash of the wick falls due to combustion is remarkably reduced, and thus, the candle is not stained, and it is clearly combusted in view of aesthetic aspect.

In addition, occurrence of smoke and soot due to combustion may be remarkably reduced.

Further, the tunnel phenomenon due to the thermal conduction of the wick may be suppressed.

As described above, although preferred embodiments of the present invention are described, the present invention should be construed as including all the changes, modification, and equivalent, such that it is obvious that the present invention may be equivalently utilized by appropriately modifying the above-described exemplary embodiments. Therefore, the above-description is not intended to limit the scope of the present invention defined by limitation of the following claims.

What is claimed is:

1. A wick for a candle comprising a carbon material vaporized into carbon dioxide gas at a time of combustion, wherein the carbon material is any one or a mixture or a composite of two or more selected from carbon fiber, activated carbon, carbon nanotube, graphite, carbon black, graphene, graphene oxide, and a carbon composite material, and the carbon material is dispersed in a matrix forming the wick.

2. The wick for a candle of claim 1, wherein the carbon material has a form of any one or two or more selected from long fibers, short fibers, fabrics and particles.

3. The wick for a candle of claim 2, wherein the wick is selected from the following (i) to (v):

(i) a wick formed of the carbon material alone, (ii) a wick in which the carbon material is dispersed in a matrix formed of any one selected from a binder and pulp, or a mixture thereof, (iii) a wick including the carbon material in a fabric formed of any one or two or more fibers selected from natural fibers and synthetic fibers, (iv) a wick including the carbon material in the fabric formed of any one or two or more fibers selected from natural fibers and synthetic fibers, the fabric being coated or impregnated with a binder, and (v) a wick including the carbon material and any one or two or more short fibers selected from short fibers of natural fibers and short fibers of synthetic fibers, in the matrix formed of any one selected from a binder and pulp, or a mixture thereof.

4. The wick for a candle of claim 3, wherein the wick has a web form including pores in the wick to allow fuel of the candle to be moved by a capillary phenomenon.

5. The wick for a candle of claim 3, further comprising: a supporter selected from a wood wick, a zinc wick, a tin wick, and a zinc-tin mixed metal wick.

6. The wick for a candle of claim 3, wherein the binder has a melting temperature satisfying Equation 1 below:

$$\text{melting temperature of fuel used in candle} < \text{melting temperature of binder.} \quad \text{[Equation 1]}$$

7. The wick for a candle of claim 1, wherein the wick is coated with wax.

8. The wick for a candle of claim 1, further comprising: a wick clip.

9. A candle comprising the wick for a candle of claim 1.

10. The candle of claim 9, wherein the candle includes any one or two or more fuels selected from paraffin wax, paraffin oil, soy wax, bees wax, palm wax, and gel wax.

11. The candle of claim 10, wherein the fuel further includes any one or two or more additives selected from fragrance and dye.

12. The wick of a candle of claim 3, wherein the wick is formed of a sheet including carbon material short fibers, pulp and a binder, in which the pulp is fibrillated cellulose-based fiber having a three-dimensional mesh structure, and the carbon material short fibers are dispersed in the wick.

* * * * *